US008578749B2

(12) United States Patent
Klein et al.

(10) Patent No.: US 8,578,749 B2
(45) Date of Patent: Nov. 12, 2013

(54) METHOD FOR THE FLYING CHANGING OF WORKING ROLLS IN CONTINUOUS CASTING AND ROLLING INSTALLATIONS AND HOT STRIP ROLLING MILLS USING A HOLD-DOWN ROLLER

(75) Inventors: Christoph Klein, Kreuztal-Eichen (DE); Frank Benfer, Bad Laasphe (DE); Ernst Windhaus, Duisburg (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 0 days.

(21) Appl. No.: 13/640,102

(22) PCT Filed: Apr. 6, 2011

(86) PCT No.: PCT/EP2011/055307

§ 371 (c)(1),
(2), (4) Date: Nov. 13, 2012

(87) PCT Pub. No.: WO2011/124585

PCT Pub. Date: Oct. 13, 2011

(65) Prior Publication Data

US 2013/0055782 A1 Mar. 7, 2013

(30) Foreign Application Priority Data

Apr. 9, 2010 (DE) ..... 10 2010 014 346

(51) Int. Cl.
*B21B 37/48* (2006.01)
*B21B 31/08* (2006.01)

(52) U.S. Cl.
USPC ..... 72/238; 72/11.4

(58) Field of Classification Search
USPC ..... 72/11.1, 11.3, 11.4, 12.2, 12.3, 237, 72/238, 239
See application file for complete search history.

(56) References Cited

U.S. PATENT DOCUMENTS

| | | | | |
|---|---|---|---|---|
| 3,759,078 | A | 9/1973 | Rotter | |
| 3,877,276 | A | 4/1975 | Petros | |
| 4,685,390 | A * | 8/1987 | Pav et al. | 72/239 |
| 4,964,289 | A * | 10/1990 | Dean | 72/12.2 |
| 5,007,272 | A * | 4/1991 | Matsunaga et al. | 72/238 |
| 5,802,902 | A | 9/1998 | Rosenthal et al. | |
| 6,216,516 | B1 | 4/2001 | Klamma | |
| 6,227,021 | B1 * | 5/2001 | Imanari | 72/12.3 |
| 7,165,432 | B2 | 1/2007 | Berendes | |

FOREIGN PATENT DOCUMENTS

| | | |
|---|---|---|
| DE | 24 33 569 | 1/1976 |
| DE | 38 29 066 | 3/1990 |
| JP | 56 144805 | 11/1981 |
| JP | 59 070412 | 4/1984 |
| JP | 63 130202 | 6/1988 |
| JP | 63 132705 | 6/1988 |
| JP | 63 171 204 | 7/1988 |
| JP | 63 252607 | 10/1988 |

* cited by examiner

*Primary Examiner* — Teresa M Ekiert
(74) *Attorney, Agent, or Firm* — Abelman, Frayne & Schwab

(57) ABSTRACT

The invention relates to a method of flying changing of working rolls in continuous casting and rolling installations and hot strip rolling mills, in particular in continuous hot strip rolling mills, wherein for exchange of working rolls by opening a rolling stand, those are disengaged from a to be rolled hot strip. According to the invention a regulated strip tension that can substitute the tension of the open rolling stand, is applied to the to-be-rolled hot strip with at least one hold-down roller that is introduced in a rolling line.

6 Claims, 1 Drawing Sheet

METHOD FOR THE FLYING CHANGING OF WORKING ROLLS IN CONTINUOUS CASTING AND ROLLING INSTALLATIONS AND HOT STRIP ROLLING MILLS USING A HOLD-DOWN ROLLER

RELATED APPLICATIONS

This application is a National Stage application of PCT application PCT/EP2011/055307 filed on Apr. 6, 2011 and based on German Priority application DE 10 2010 014346 filed Apr. 9, 2010, both applications being incorporated herein by reference thereto.

BACKGROUND OF THE INVENTION

1. Field of the Invention

The invention relates to a method of flying changing of working rolls in continuous casting and rolling installations and hot strip rolling mills, in particular in continuous hot strip rolling trains.

2. Description of the Prior Art

Working rolls of a rolling stand are naturally subjected to wear which can lead to quality loss of the surface of a rolled strip.

To prevent this, an exchange of rolls is needed from time to time.

For hot rolling, to-be-rolled strip should be heated to a necessary temperature, this being the case even when it is rolled immediately after casting. When a short furnace is used without a buffer or the furnace is completely omitted because of a continuous casting and rolling, a continuous rolling operation of the casting-rolling operation need be stopped for changing the working rolls. Therefore, the loss of production is not prevented.

A continuous casting and rolling operation with long casting runs is not possible without loss of quality of the strip surface.

During cold rolling operation, this is not a problem, because here the strip is stopped, and then the roll exchange is carried out.

In CSP continuous operation, this is not possible because the casting process is directly connected with the rolling process and cannot be stopped. The stoppage of the casting process would immediately lead to disruption of casting, and the production process would be interrupted.

Therefore, it is important that when a working roll exchange must be carried out during casting, it should also be carried out during rolling, i.e., with a running strip.

However, the roll exchange can be carried out only with an open rolling stand.

If a respective rolling stand is open, the rolling cannot take place in this rolling stand and, thus, no thickness reduction would take place. To compensate for this, the reduction of the open rolling stand should be distributed between surrounding rolling stands, i.e., the engaged rolling stands should take over additionally the rolling work of the open rolling stand during the roll exchange. Failing this, the possibility of the band tension regulation would be normally taken over by a loop lifter that is normally arranged in a continuous rolling train between two following one another, rolling stands. However, this is not any more possible because of the open rolling stand. If despite of this, a loop lifter, which is arranged in front of or behind the open rolling stand, is active, the strip, as the case may be, would be pressed against the upper working roll of the open rolling stand. In this case, the roll exchange would not be possible.

The object of the invention is to enable a flying working roll exchange in a casting and rolling installation or in a continuously operating hot strip rolling mill and, thereby, to provide for shortening/elimination of the buffer time in the furnace, shortening of the furnace, reduction of investment and a smaller energy consumption, and thereby, for cost-effective production process.

SUMMARY OF THE INVENTION

This object is achieved, according to the invention, by a method of flying changing of working rolls in continuous casting and rolling installations and hot strip rolling mills, in particular in continuous hot strip rolling trains, wherein for exchange of working rolls by opening a rolling stand, those are disengaged from a to be rolled hot strip, and a regulated strip tension that can substitute the tension of the open rolling stand, is applied to the to-be-rolled hot strip with at least one hold-down roller that is introduced in a rolling line.

When a rolling stand is open for a roll exchange, the upper working roll of the open rolling stand should be free so that it cannot keep the strip down any more.

This effect could further be strengthen when a loop lifter, which is usually arranged between the rolling stands, presses the hot strip upward.

In order to retain a proper strip tension, the holding-down function is taken over by a hold-down roller that cooperates with the loop lifter. Because the space proportions between the rolling stands are noticeably reduced, this hold-down roller is formed with particularly small dimensions.

It makes sense to carry out strip monitoring during rolling. This serves for identifying a strip region which would be rolled during the roll exchange. This information is necessary when during the roll exchange, e.g., the temperature or the thickness regulation cannot be adequately maintained for process-technical reasons (limitations) or, e.g., rolling stand setting errors. In this case, a defective or to-be-rejected piece of a rolled strip is produced which during further processing should be separated from the error-free strip. This is possible more easily when the beginning and the end of the error-containing strip region are already known.

During the roll exchange, generally, it should be taken care of that the temperature control is maintained during the rolling process. To insure this, if necessary, regulation of cooling or heating within the rolling mill train is to be carried out during the working roll changing process.

The inventive method will be described in detail below with reference to the drawings.

DETAILED DESCRIPTION OF THE PREFERRED EMBODIMENT

Figure 1:
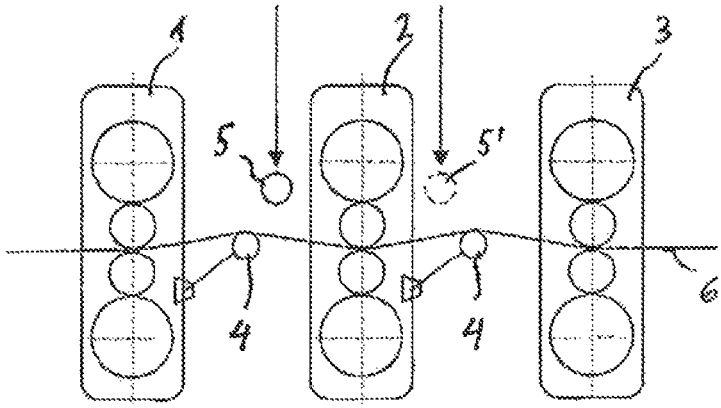
FIG. 1 a normal rolling process with a closed rolling stand.

Between rolling stands 1, 2 and 3, a conventional loop lifter 4 with which the strip tension is adjusted, is located. During a normal rolling process, as shown in FIG. 1, neither a hold-down roller 5 located in front of the rolling stand 2, nor a hold-down roller 5' located behind the rolling stand, when available, engage the hot strip 6.

Figure 2:
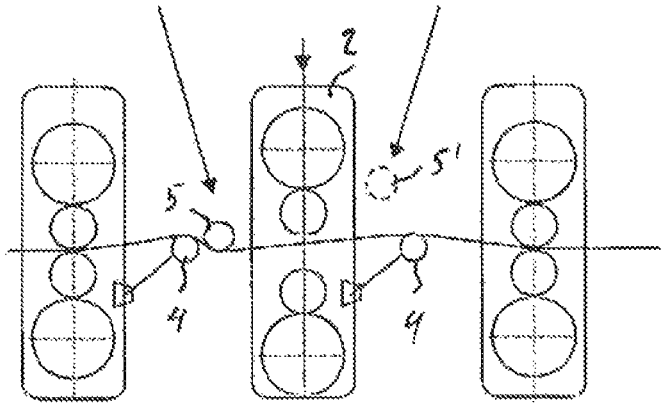
FIG. 2 a rolling process with an open rolling stand for effecting roller exchange, and an active hold-down roller.
Figure 3:
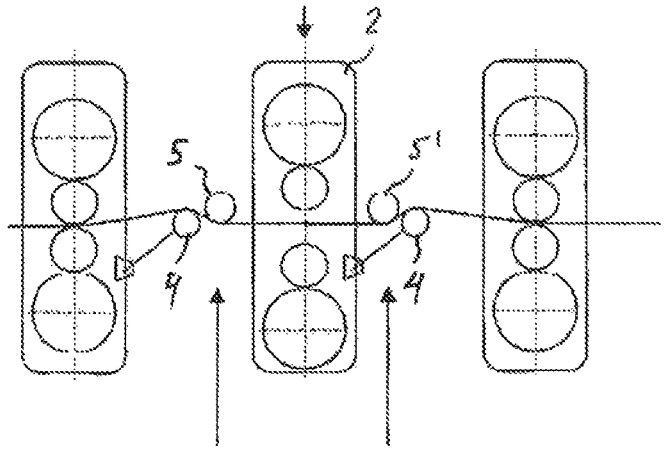
FIG. 3 a further hold-down roller active in the outlet region to reliably prevent contact of a strip with the upper working roll of the open rolling stand.

In order, e.g., to change the working rolls in the middle rolling stand 2, the rolls should be lifted, as shown in FIG. 2.

Because the hot strip does not have any contact with working rolls, at least the hold-down roller 5 which is located in front of the rolling stand 2 becomes active, together with the loop lifter 4 associated with this hold-down roller, so that the hot strip can be displaced, without contacting the working rolls, through the open rolling stand with the corresponding strip tension.

The flying changing of the working rolls itself can be effected with conventional devices.

Thus, e.g., the working roll pair can be so displaced in a rolling stand during pulling out or pushing in using specially formed rails, that the upper roll jacks up, and both rolls do not contract the strip located in the rolling train.

Before roll exchange, change of the rolling program takes place. The regulation of the strip tension between the rolling stands is carried out with the inventive hold-down roller.

Alternatively, a changing device can be placed in front of a rolling stand in which an exchange takes place. The device carries new rolls. The old rolls are lifted and after a transverse displacement, the new rolls are pushed in the rolling stand.

The invention claimed is:

1. A method of flying changing working rolls in a continuous hot strip rolling mill having a rolling mill train each other rolling stands for rolling a hot strip, the method comprising the steps of:

providing at least one hold-down roller that is spaced from a hot rolled strip during operation of all of the stands of the rolling mill train;

opening a respective rolling mill stand for enabling changing of a working roll; and moving the at least one hold-down roller into engagement with the hot rolled strip for providing a strip tension capable to substitute a strip tension provided by the open rolling stand in an operational condition thereof.

2. A method according to claim 1, comprising the step for monitoring the strip for identifying a strip region to-be-rolled during the roll exchange.

3. A method according to claim 1, including the step of maintaining a temperature control during the roll exchange by regulating cooling or heating within the rolling mill train.

4. A method according to claim 1, comprising the step of providing a loop lifter that cooperates with at the at least one hold-down roller for guiding the hot rolled strip.

5. A method according to claim 4, wherein the step of providing at least hold-down roller includes arranging the at least one hold-down roller between the respective stands and above the hot-rolled strip, and the loop lifter providing step includes arranging the loop lifter between the respective stands beneath the hot rolled strip.

6. A method according to claim 5, wherein the at least one hold-down roller and the loop lifter are shifted relative to each other in a rolling direction of the hot rolled strip.

* * * * *